US010851710B2

(12) United States Patent
Mezheritsky

(10) Patent No.: US 10,851,710 B2
(45) Date of Patent: Dec. 1, 2020

(54) AUTOMATED ENGINE CLEANING SYSTEM AND METHOD

(71) Applicant: Victor Mezheritsky, Vancouver (CA)

(72) Inventor: Victor Mezheritsky, Vancouver (CA)

( * ) Notice: Subject to any disclaimer, the term of this patent is extended or adjusted under 35 U.S.C. 154(b) by 0 days.

(21) Appl. No.: 16/209,944

(22) Filed: Dec. 4, 2018

(65) Prior Publication Data

US 2020/0173358 A1 Jun. 4, 2020

(51) Int. Cl.

| | |
|---|---|
| ***F02B 77/04*** | (2006.01) |
| ***B05B 1/02*** | (2006.01) |
| ***B05B 1/14*** | (2006.01) |
| ***B08B 3/02*** | (2006.01) |
| ***B08B 9/032*** | (2006.01) |
| ***F01D 25/00*** | (2006.01) |
| ***F04D 29/70*** | (2006.01) |
| ***B08B 3/10*** | (2006.01) |

(52) U.S. Cl.

CPC ..... *F02B 77/04* (2013.01); *B05B 1/02* (2013.01); *B05B 1/14* (2013.01); *B08B 3/02* (2013.01); *B08B 3/10* (2013.01); *B08B 9/0321* (2013.01); *F01D 25/002* (2013.01); *F04D 29/705* (2013.01); *F02B 2077/045* (2013.01)

(58) Field of Classification Search

None

See application file for complete search history.

(56) References Cited

U.S. PATENT DOCUMENTS

| | | | | |
|---|---|---|---|---|
| 5,095,882 | A | 3/1992 | Christensen | |
| 5,125,377 | A * | 6/1992 | Mezheritsky ..... | F01D 25/002 123/198 A |
| 5,343,831 | A | 9/1994 | Collins | |
| 6,004,382 | A | 12/1999 | Pikesh et al. | |
| 8,667,796 | B2 | 3/2014 | Järvi | |

* cited by examiner

*Primary Examiner* — Michael E Barr
*Assistant Examiner* — Jason P Riggleman
(74) *Attorney, Agent, or Firm* — Orin Del Vecchio

(57) ABSTRACT

The present invention relates to an automated washing system for an internal combustion engine, comprising: a control system, operative to monitor the engine and automatically initiate a washing cycle; a water tank with a heating element to heat water within the water tank; set of air compressor cleaning injectors connected to the water tank; a set of air cooler cleaning injectors connected to the water tank; a set of air intake port/valve cleaning injectors connected to the water tank; wherein the air compressor cleaning injectors and the air cooler cleaning injectors are operated simultaneously during a washing cycle.

18 Claims, 9 Drawing Sheets

SECTION A-A

VIEW B

SECTION A-A

VIEW B

VIEW C

FIGURE 8A VIEW A

FIGURE 8B VIEW B

AUTOMATED ENGINE CLEANING SYSTEM AND METHOD

FIELD OF THE INVENTION

The present specification relates generally to the maintenance and cleaning of combustion engines, and more particularly to an automated cleaning system for diesel engines.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

It is generally known that during normal operation of diesel engines, particularly turbocharged or supercharged engines, a gradual decrease in performance is noticed. One of the known causes for this decrease is the fouling of the turbochargers (both air and gas sides), the scavenging air coolers, the air intake manifolds the scavenging ports and/or the intake valves. The air in a typical engine room is not clean, rather it is contaminated with particles, often very fine, of dust and evaporated oil, and exhaust gases. Thus, this air is drawn in to the compressor side of the turbocharger and forced into the engine cylinders, passing through the air cooler, intake manifold, and the intake ports/valves, and these contaminates are deposited onto the engine components. It is generally considered impossible to avoid this process.

The majority of the deposits settle in the compressor, on the compressor wheel and diffuser, and on the air cooler (due to the large surface area of the fins on the cooling pipes). Once the deposits begin to form, they initially accumulate very quickly. The most rapid growth of the deposit layer takes place during the first 50-200 hours of operation, with slower growth over the next 1000+ hours, and stabilizes around the 1500 hour range.

The formation and accumulation of these deposit reduces the area available for air flow and increases air resistance in the air cooler. Thus, the air intake for engine combustion is reduced and the performance and efficiency of the engine deteriorates, with increases exhaust gas temperatures, thermal stresses and fuel consumption, and decreases in engine power. Additionally, the deposits accumulated on the compressor wheel and diffuser can cause engine surging, which would requires stopping the engine and dismantling the compressor to clean and remove all accumulate deposits to restore normal operation.

Therefore, in order to maintain normal operation, the engine must be kept clean from deposits. There are washing systems promoted on the market, but their effectiveness has shown itself to be limited, with engines still required periodic shutdown and dismantling for cleaning in order to restore acceptable performance. Additionally, for these reasons discussed above, the deposits also re-accumulate in a relative short time period.

One issue with existing washing systems is that there are typically two separate washing systems: one for cleaning the compressor side, generally designed and supplied by a turbocharger manufacturer, and one for cleaning the air cooler, generally designed and supplied by an engine manufacturer. The systems tend to work at odds with each other, as turbocharger washing systems inject small amounts of water into the compressor space, resulting in any deposits which are removed travelling into the air cooler, and then into the intake manifold and intake ports/valves. Thus, engine performance issues are merely relocated, rather than addressed.

Similarly, the washing systems for the air coolers generally require the engine to be shut down for cleaning, thus requiring an opportunity for an operational shut down to take place before cleaning can even begin. Depending on the time between cleanings, it is even more likely that some deposits will not be removable by the cleaning process due to the depth and strength of accumulation.

Another alternative is the use of chemical (e.g. solvent-based) cleaners. However, these cleaners introduce their own side effects, including potential corrosion or erosion of engine parts, contamination of lubrication oil, and adverse reactions from residual chemicals exposed to hot engine operating temperatures, which may require replacement of the air cooler if severe enough.

A new washing system was proposed in U.S. Pat. No. 5,125,377 to Mezheritsky, the inventor of the present application. This system proposes to clean the compressor side of the turbocharger, and then the engine air cooler and air intake manifold in sequence while the engine is running. While better cleaning performance was achieved, practical experience showed that deposits continued to remain and accumulated inside the air cooler.

Accordingly, there remains a need for improvements in the art.

SUMMARY OF THE INVENTION

In accordance with an aspect of the invention, there is provided an automated cleaning system for diesel engines.

According to an embodiment of the invention, there is provided an automated washing system for an internal combustion engine, comprising: a control system, operative to monitor the engine and automatically initiate a washing cycle; a water tank with a heating element to heat water within the water tank; set of air compressor cleaning injectors connected to the water tank; a set of air cooler cleaning injectors connected to the water tank; a set of air intake port/valve cleaning injectors connected to the water tank; wherein the air compressor cleaning injectors and the air cooler cleaning injectors are operated simultaneously during a washing cycle.

According to a further embodiment of the invention, there is provided a method of automatically washing an internal combustion engine, comprising: detecting that the engine is in a state which requires a washing; activating a set of air compressor cleaning injectors and a set of air cooler cleaning injectors simultaneously to wash a compressor side of a turbocharger and air cooler, respectively; deactivating the air compressor cleaning injectors and the air cooler cleaning injectors; and activating a set of air intake valve/port cleaning injectors to wash air intake valves/ports in an air intake manifold, wherein the method is executed while the engine is in operation.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

Reference will now be made to the accompanying drawings which show, by way of example only, embodiments of the invention, and how they may be carried into effect, and in which:

FIG. 8A is a cross-section of section A of FIG. 8; and

FIG. 8B is an end view of the injector of FIG. 8.

Like reference numerals indicated like or corresponding elements in the drawings.

DETAILED DESCRIPTION OF THE EMBODIMENTS

The present invention relates to the maintenance and cleaning of combustion engines, and more particularly to an automated cleaning system for diesel engines.

From practical observation of the existing washing systems discussed above, the following elements are considered relevant to the performance of a washing system and consequently, to the performance of the engine.

First, the washing of the air compressor (turbocharger) and air cooler should be carried out simultaneously to avoid deposits from the air compressor settling down in the air cooler. Second, the washing system should be fully automated, to avoid requiring engine room crew time for washing and thus the possibility of washing cycles not been executed properly or at all and on proper schedule.

Third, the design, number and installation of the cleaning injectors for each to the compressor and turbine sides of the turbocharger, the air cooler, and the scavenging air ports, and intake/exhaust valves should be considered. Finally, with respect to the cleaning water, the quantity and temperature of water used, the frequency of washing cycles, and the air pressure used to atomize the water, with the resulting size of the water droplets and the angle of the spray jets, should all be factored into the design.

Accordingly, the washing system described herein provides for automated simultaneous washing of the compressor side of the turbocharger and the air coolers, followed by sequential washing of the air intake manifold and the intake ports/valves. Additionally, the washing system may be operated while the engine is running.

PARTS LIST

Figure 1:
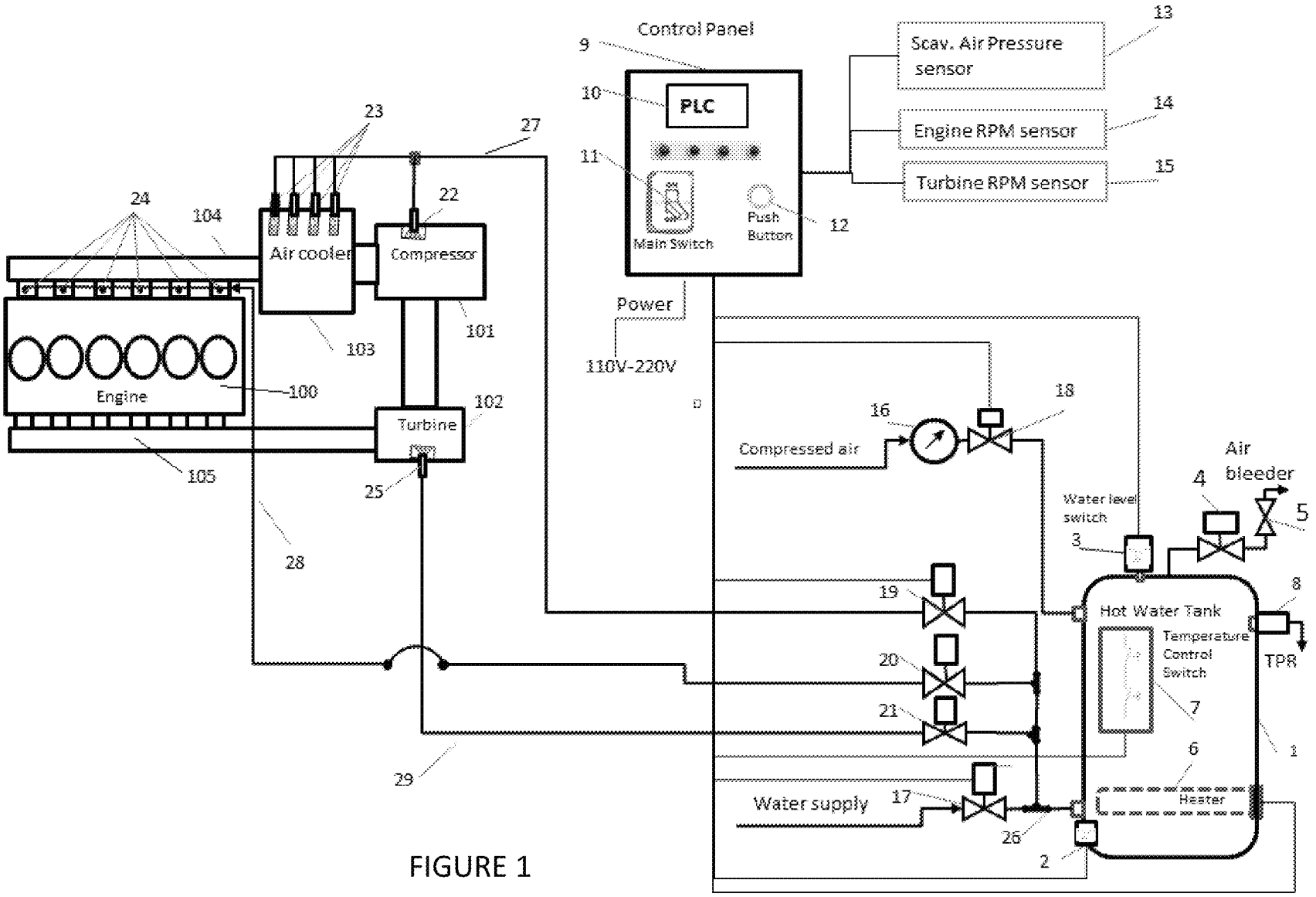
FIG. 1 is a schematic of an automated washing system according to an embodiment.

1—water tank;
2—low water level sensor;
3—high water level sensor;
4—solenoid valve;
5—air bleeder valve;
6—electrical heater;
7—temperature control sensor;
8—high temperature/high pressure relief valve;
9—control panel;
10—programmable logic controller (PLC);
11—main power switch for the control panel;
12—push button for washing the turbine;
13—scavenging air pressure sensor;
14—engine RPM sensor;
15—turbine RPM sensor;
16—air pressure regulator;
17—hot water supply solenoid valve;
18—compressed air supply solenoid valve;
19—water discharge solenoid valve for air compressor and air cooler;
20—water discharge solenoid valve for scavenging air ports/valves;
21—water discharge solenoid valve for turbine;
22—cleaning injector for air compressor;
23—cleaning injectors for air cooler;
24—cleaning injectors for air intake ports/valves;
25—cleaning injector for turbine;
100—internal combustion engine
101—air compressor
102—turbine
103—air cooler
104—air intake manifold
105—exhaust gas manifold According to an embodiment as shown in FIG. 1, an automated washing system is designed for use with an internal combustion engine 100 having a turbocharger comprising an air compressor 101 and a turbine 102. The engine further has an air cooler 103, air intake manifold 104 and exhaust gas manifold 105.

In operation, the washing system is turned on via a main switch 11 on a control panel 9, with the programmable logic controlled (PLC) 10 receiving signals from all available sensors once in a powered state to identify the engine's present condition. If the engine condition matches the preset data for cleaning, a signal is sent to the hot water supply solenoid valve 17 to open and the hot water will flow through the water supply line 26 to start filling the water tank 1.

Next, the air from the water tank 1 will escape through (normally open) solenoid valve 4 and the air bleeder 5. Once the water tank 1 is filled with water, a high water level sensor sends a signal to the PLC and it will then shut off the hot water supply valve 17 and then send a signal to a magnetic starter to turn on the electrical heater 6. This starts a heating process which continues until the water reaches a preset temperature (normally around 95° C.), at which point a temperature control sensor 7 sends a signal to the PLC to shut off the heater 6. With the water tank filled and the water heated, the washing system is in a ready-to-use state.

The size of the water tank 1 is based on the water requirements to complete the washing cycles, which is dependent upon the size of the engine, the engine output power, the size of the air cooler 103 and the number of air coolers/turbochargers, among other factors. Additionally, to conserve energy, where hot water is available, such as on a ship where tanks of hot water (approx. 60° C.) are maintained, this hot water may be used to fill water tank 1, reducing the energy requirements to power the electric heater in order to raise the temperature of the water in the water tank to the necessary temperature (approx. 95° C.) for use.

Washing the Air Compressor and Air Cooler

With the washing system ready to use, the air compressor cleaning cycle may be initiated. The PLC 10 sends signals to 1) close solenoid valve 4 to prevent air bleeding; 2) open compressed air supply solenoid valve 18 to pressurize water tank 1; and 3) open water discharge solenoid valve 19 for the air compressor 101 and air cooler 103. Consequently, water is discharged through the discharge line 27 to the air compressor cleaning injector 22 and the air cooler cleaning injector 23 simultaneously.

Once all the water is discharged from the water tank 1, a low level water sensor 2 sends a signal to the PLC, which then sends a signal to close compressed air supply solenoid valve 18 and water discharge solenoid valve 19. A new signal may then be sent to open solenoid valve 4 and hot water supply solenoid valve 17 to start filling water tank 1 and return the washing system to a ready-to-use state.

Washing the Air Intake Ports/Valves

With the washing system ready to use again, the air intake port cleaning cycle may be initiated. As above, PLC 10 sends signals to close solenoid valve 4 to prevent air bleeding and open compressed air supply solenoid valve 18 to pressurize water tank 1. A signal is then sent to discharge solenoid valve 20 for the air intake ports/valves in air intake manifold 104. Water is then discharged through discharge line 28 to the air intake ports/valves cleaning injectors 24.

As above, once all the water is discharged, a signal is sent to close compressed air supply solenoid valve 18 and begin the water tank refilling process as described above.

Additionally, once the washing cycle is completed the PLC 10 begins to track time and sensor data to determine when the levels are reached (e.g. operational time) to trigger a new washing cycle.

Washing the Turbine Side of the Turbocharger

Additional performance benefits may be achieved by washing of the turbine side of the turbocharger as well. However, this cleaning needs to take place when the engine is in a low load state, which may require manual intervention in addition to the automated process. Thus, when the system is ready—sensor indicated that washing is required and the washing system is prepared to begin, the washing process is triggered by a manual input (e.g. push button) 12 when the engine is in a low load state.

As described above, PLC 10 sends signals to close solenoid valve 4 and open compressed air supply solenoid valve 18 to pressurize water tank 1. Then, a signal is sent to open water discharge solenoid valve 21 for the turbine, resulting in water being discharged through discharge line 29 to the turbine cleaning injectors 25.

As above, once all the water is discharged, a signal is sent to close compressed air supply solenoid valve 18 and begin the water tank refilling process as described above.

Air Cooler Cleaning Injector Layout and Design

A significant element in the washing system, particular for washing the air cooler, are the cleaning injectors.

Figure 2:
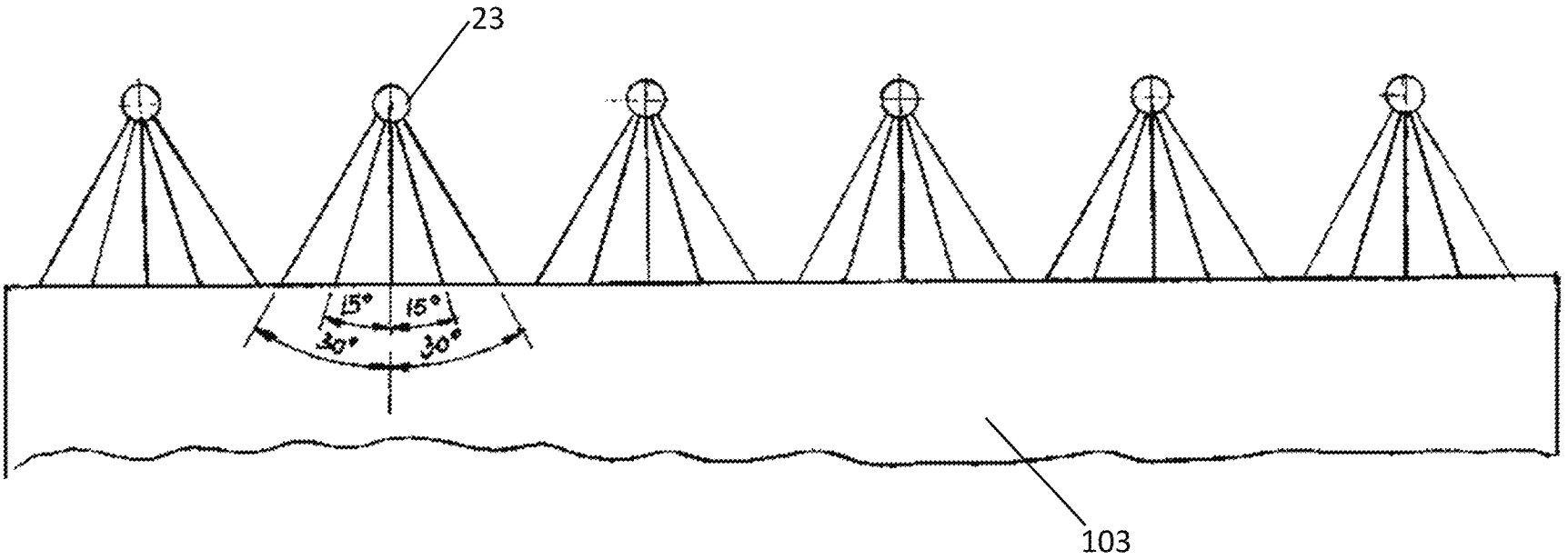
FIG. 2 is a schematic of the air cooling injector installation for the system of FIG. 1.
Figure 3:
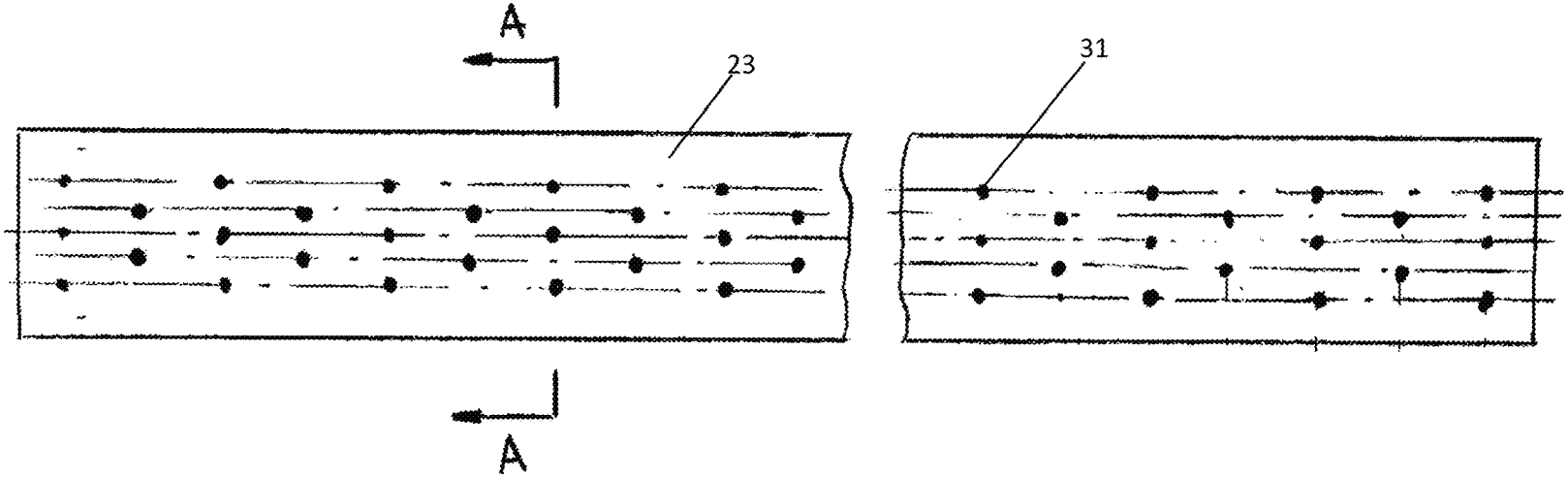
FIG. 3 is a schematic of the injectors of FIG. 2
Figure 3A:
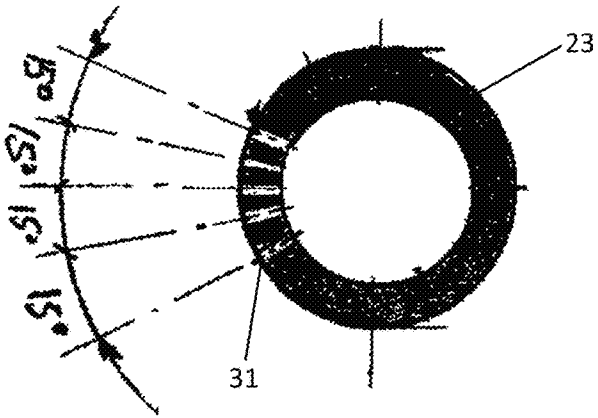
FIG. 3A is a cross-section along line A-A of FIG. 3.
Figure 4:
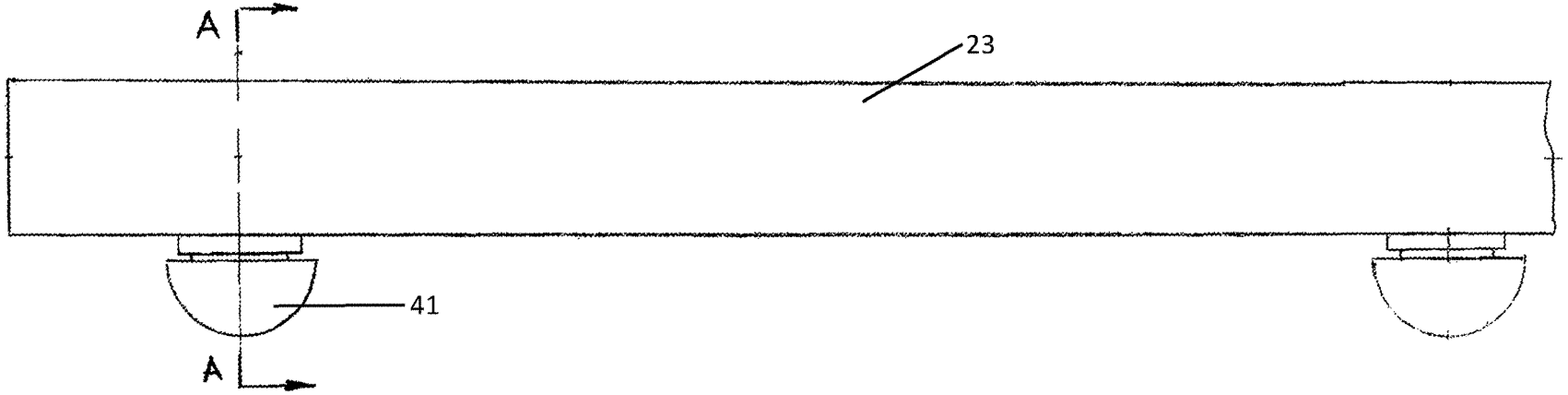
FIG. 4 is a schematic of an alternate air cooling injector installation for the system of FIG. 1.
Figure 4B:
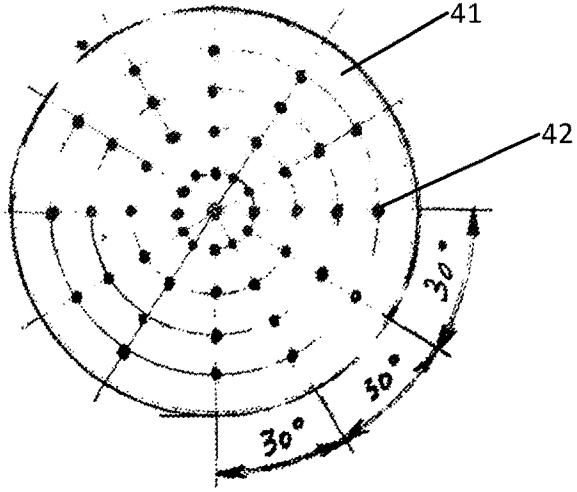
FIG. 4B is an end view of the injector of FIG. 4.
Figure 4A:
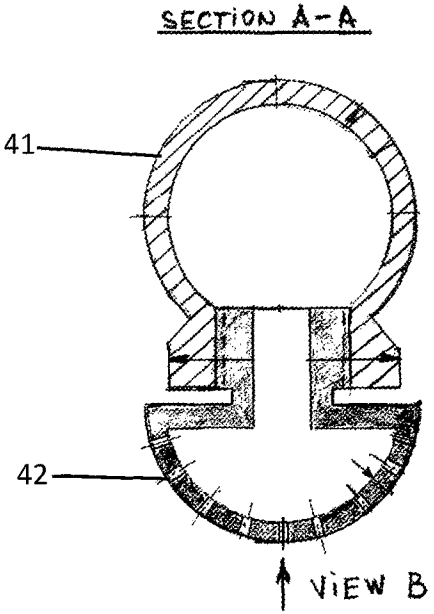
FIG. 4A is a cross-section along line A-A of FIG. 4.

A first design for the air cooler cleaning injectors 23 is shown in FIGS. 2, 3 and 3A. The number of injectors used is dependent on the size (length) of the air cooler 103, but is typically in the range of 6 to 10 injectors 23 per air cooler 103. The resulting spray output of the injectors 23 should cover then entire surface of the air cooler 103.

In one embodiment, the first and last injector 23 are located approximately 100 mm from each end of the air cooler 103. The remaining injectors 23 are then equally spaced approximately 210-230 mm apart. The spray end of the injectors 23 should be located approximately 150 mm above the top surface of the air cooler 103.

Each injector 23 may be designed with multiple spray orifices 31. One preferable design as shown in FIG. 3A has 5 rows of orifices 31, with a first row perpendicular to the air cooler 103, the next two rows at 15 degrees to the air cooler surface and the last two rows are 30 degrees to the air cooler surface. Each row has 45-60 orifices, for a total of 225-300 orifices per injector 23.

Each orifice 31 has an approximate diameter of 1 mm and they are separated in a staggered formation by approximately 20 mm. Thus, with the water injected at a pressure of 45-60 psi, each injector 23 may cover approximately 180 mm lengthwise of the air cooler surface.

Figure 5:
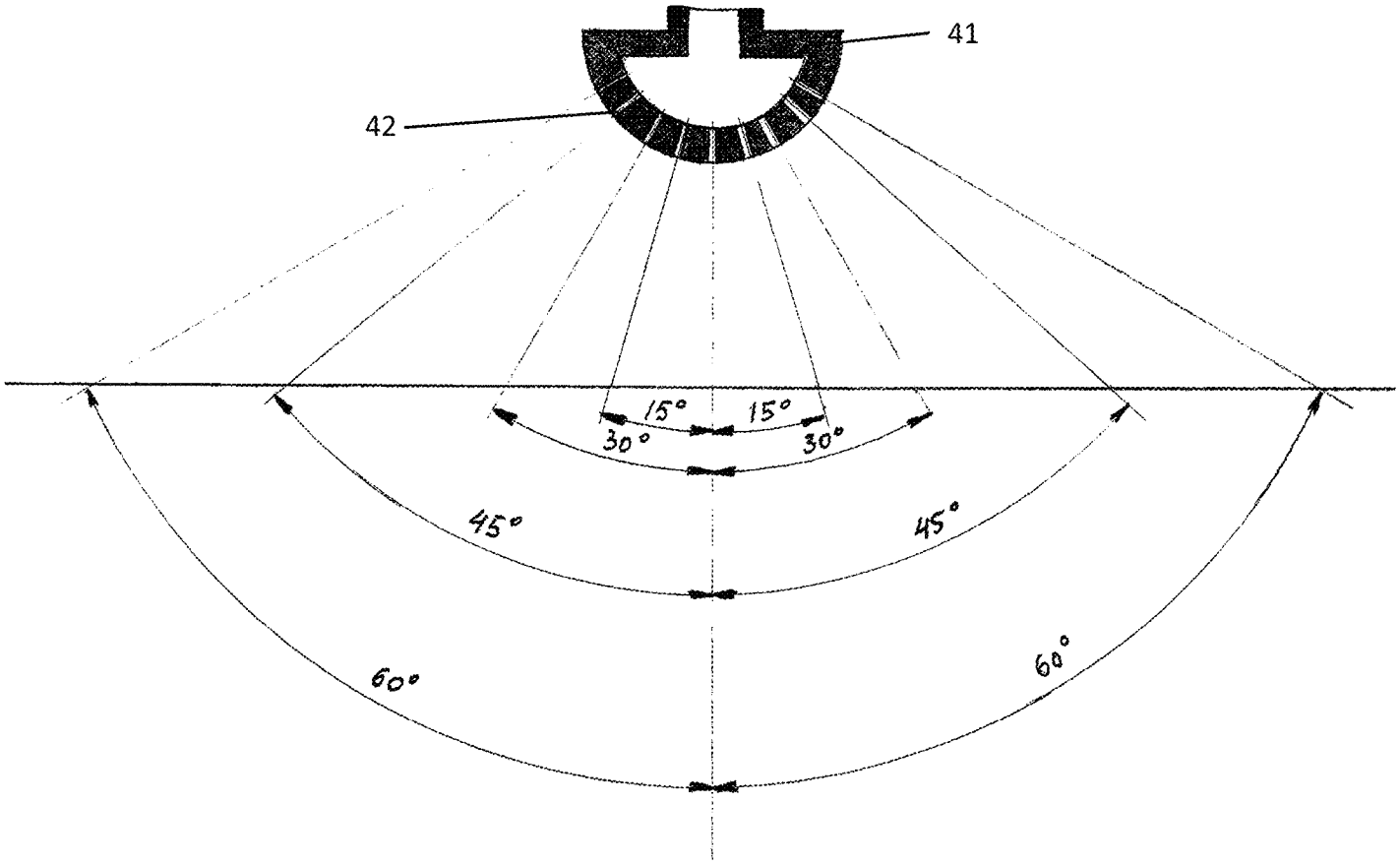
FIG. 5 is a schematic of the injector of FIG. 4A
Figure 6:
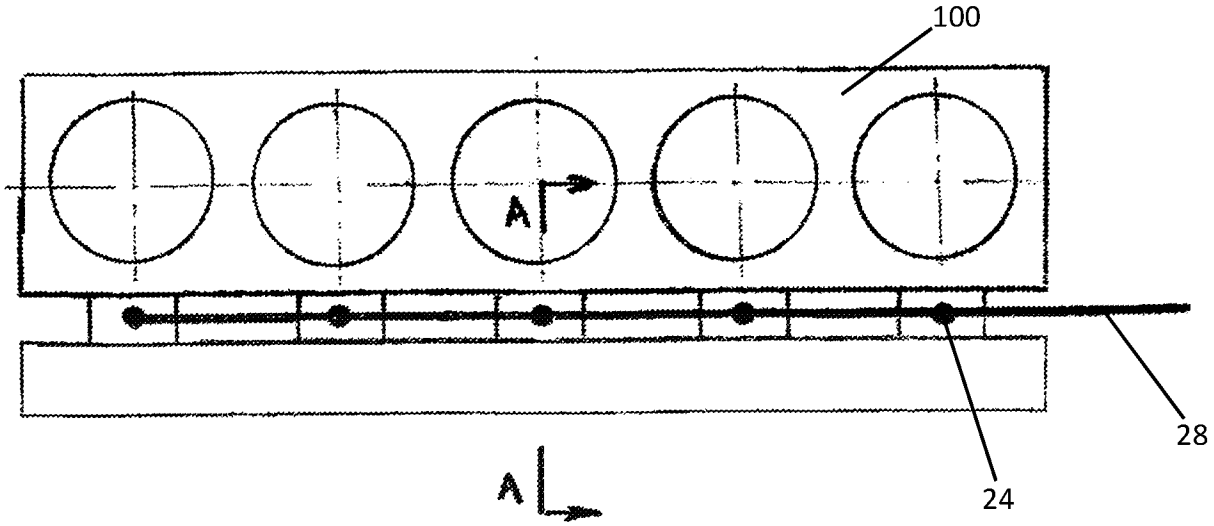
FIG. 6 is schematic of an intake port/valve injector installation for the system of FIG. 1.
Figure 6A:
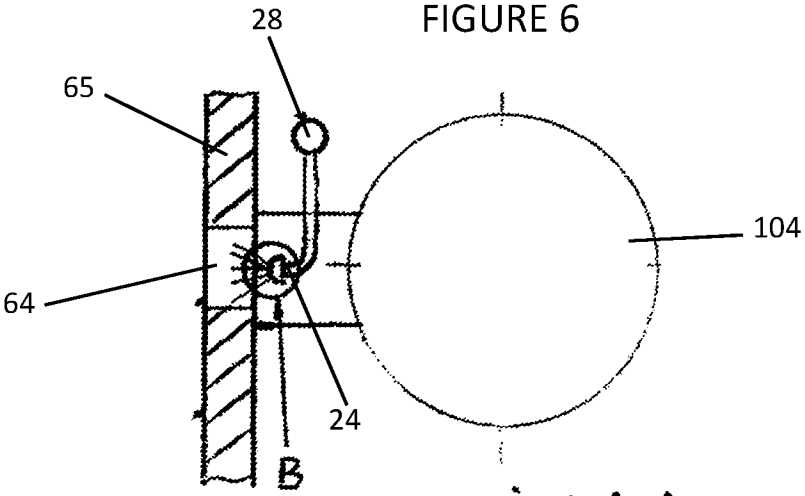
FIG. 6A is a cross-section along line A-A of FIG. 6.
Figure 6B:
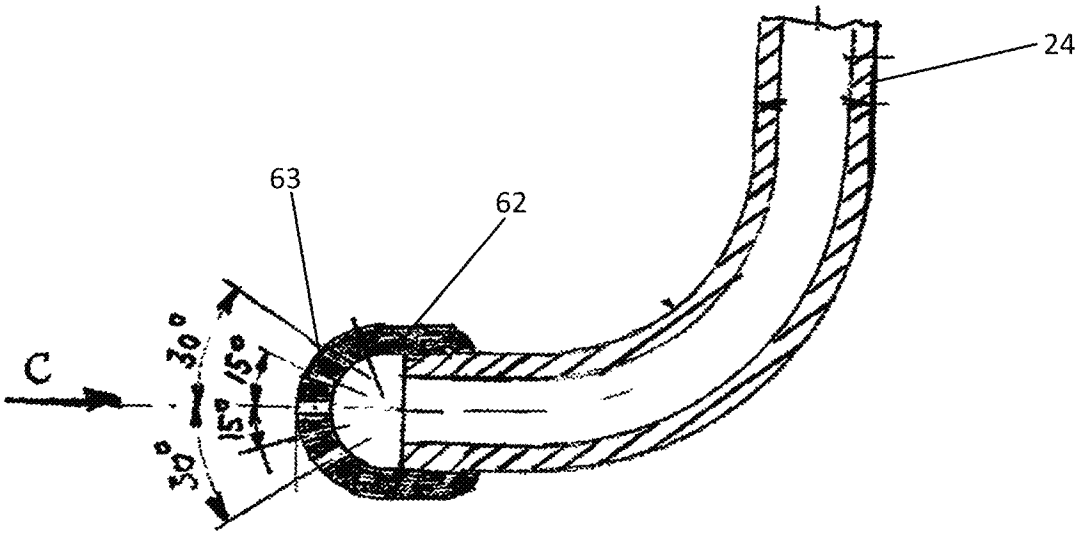
FIG. 6B is a close-up view of section B of FIG. 6A.
Figure 6C:
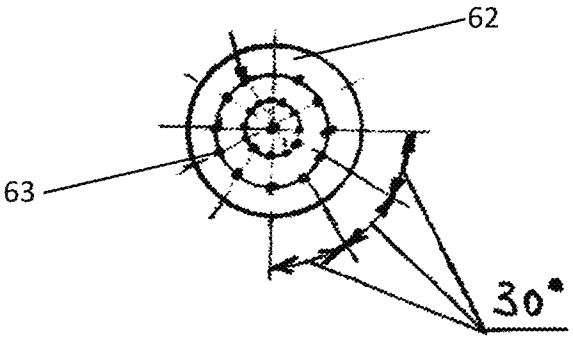
FIG. 6C is an end view of the injector of FIG. 6.

An alternative air cooler injector 23 design and layout is shown in FIGS. 4, 4A, 4B and 5. The injectors 23 are laid out in according to the pattern and dimensions described above, however the design of the injector orifices is modified. Each injector 23 is formed from an injector pipe with 3 to 5 screw-on spray heads 41 with water spraying orifices 42. The orifices 42 on each spray head are laid out with one orifice in the center and 48 distributed in four equally-spaced circumferential rows for a total of 49 orifices per spray head and 147-245 orifices per injector. Thus, as shown in FIG. 5, the center orifice sprays water perpendicular to the surface of the air cooler, the first row at 15 degrees to the surface, the second row at 30 degrees, the third row at 45 degrees, and the last row at 60 degrees to the surface.

Each spray head covers a 120-degree angle, or approximately a 450-500 mm diameter range of the air cooler surface based on the dimensions used above.

Manifold, Ports and Turbocharger Injectors

Result from existing designs suggest that injectors installed in the air intake manifold may function to clean the air manifold, but have little effect on cleaning and maintaining the engine's inlet ports and intake valves. Additionally, it was found that the air intake manifold may be generally maintained in a clean state via the water passing through after washing the air cooler. Therefore, separate injectors for cleaning the air intake manifold should not be required.

However, cleaning injectors 24 for the intake ports/valves may be used, and one design in shown in FIGS. 6, 6A, 6B and 6C. Cleaning injectors 24 are preferably installed for each cylinder 65 and as close as possible to the intake ports/valves 64. Each cleaning injector 24 is coupled to a water supply line 28 and equipped with a welded spray head 62 with 25 orifices 63. The orifices 63 are positioned in two circumferential rows of 12 around a single central orifice, with the orifices equally spaced 30 degrees apart.

The water spray from the orifices jets out at a 0-degree angle from the center orifice, a 15-degree angle from the first row and a 30-degree angle from the second row. With a orifice diameter of 0.8 mm, water pressure of 45-60 psi was found to be sufficient for cleaning.

The turbocharger has a turbine side 102 and a compressor side 101. Each side requires a separate approach to cleaning and the corresponding injectors.

Figures 7, 7A:
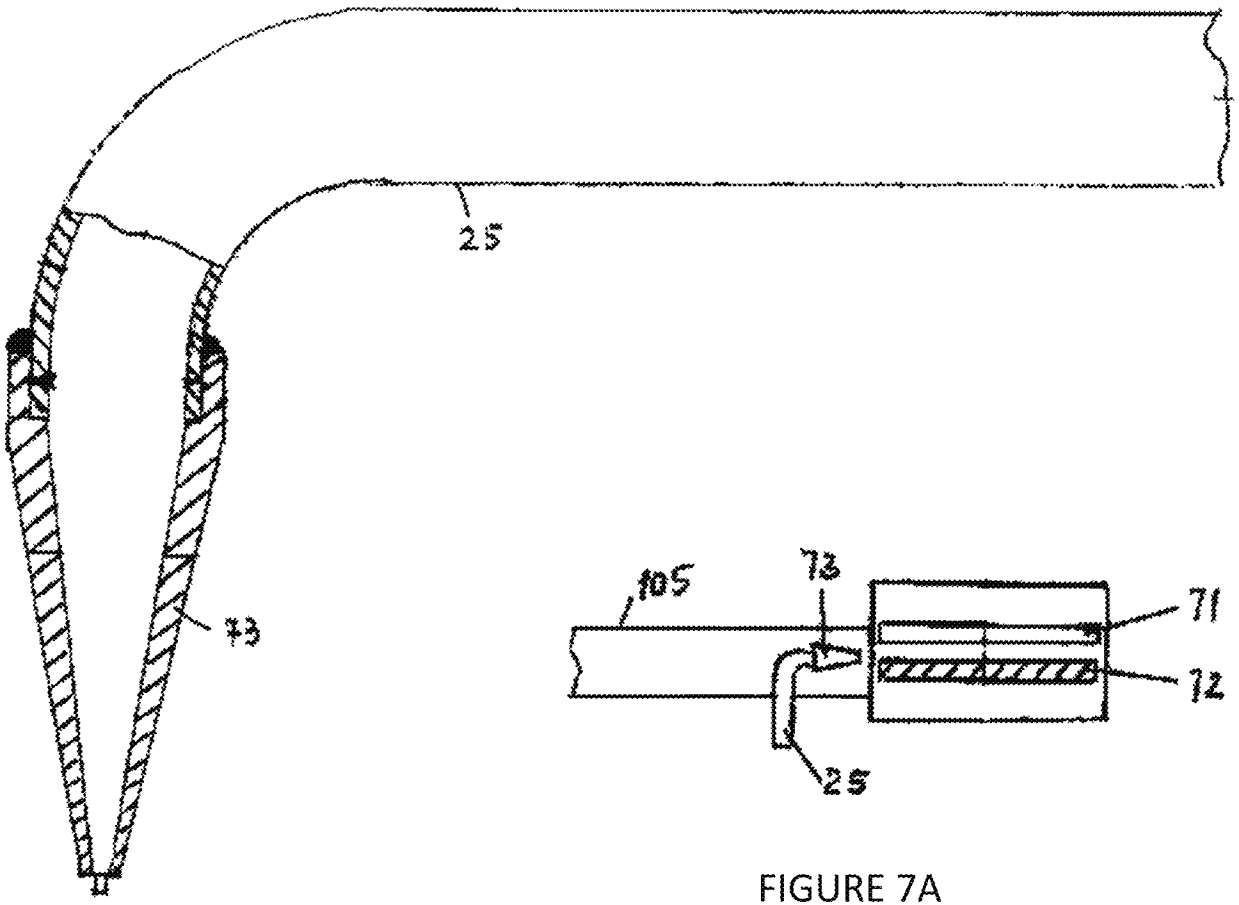
FIG. 7 is a schematic of an injector for the turbine side of the turbocharger for the system of FIG. 1.
FIG. 7A is a schematic of the installation for the injector of FIG. 7.

On the turbine side, injectors 25 are installed as close to the nozzle ring 71 and turbine blades 72 as possible as is shown in FIGS. 7 and 7A. The injectors 25 are designed with a high water speed nozzle 73 to produce a high-speed water jet to impact deposits on the turbine wheel blades, nozzle ring and inner part of the turbine casing. The size of the orifice for the injector 25 is preferably in the range of 2.5-3.5 mm and the nozzle 73 should be welded to the injector 25 for stability.

Figure 8:
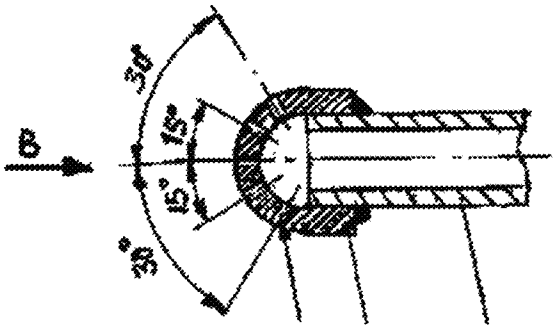
FIG. 8 is a schematic of an injector for the compressor (blower side of the turbocharger) for the system of FIG. 1.
Figure 8:
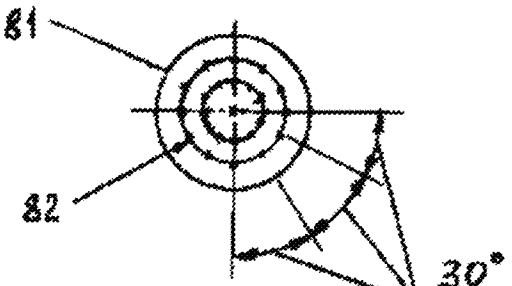
Figure 8:
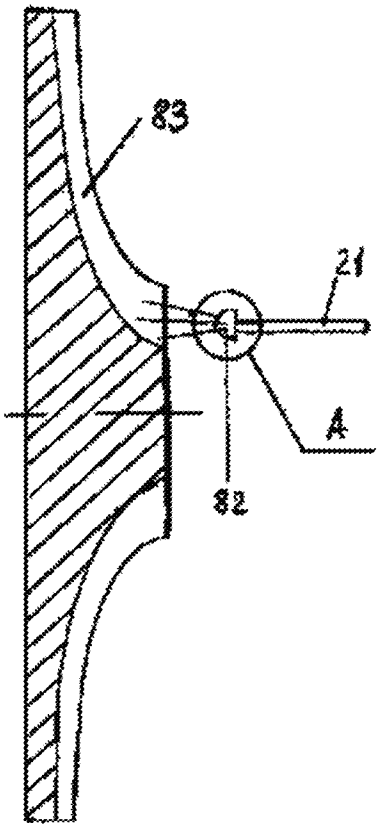

On the compressor side, prior attempts at cleaning may have demonstrated positive results in the reduction of deposits, however, the impact of the water jets used also showed pitting on the compressor impeller. Therefore, the compressor injector 21 is designed similarly to the intake injector 24 with a spray head 82 and orifices 83 the same as spray head 62 and orifices 63 to produce a water spray/mist rather than a water jet, to reduce the possibility of pitting and other damage to the compressor impeller. As shown in FIGS. 8, 8A and 8B, the center of the injector 24 should be located slightly higher (e.g. 4-5 mm) than the lower edge tip of the impeller vane 83, and the tip of the injector approximately 10 mm away from the impeller.

It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description and all changes which come within the meaning and range of equivalency of the claims are therefore intended to be embraced therein.

What is claimed is:

1. An automated washing system for an internal combustion engine, comprising:

a control system, operative to monitor the engine and automatically initiate a washing cycle;

a water tank with a heating element to heat water within the water tank;

set of air compressor cleaning injectors connected to the water tank and operably coupled to the control system;

a set of air cooler cleaning injectors connected to the water tank and operably coupled to the control system;

a set of air intake port/valve cleaning injectors connected to the water tank;

wherein the air compressor cleaning injectors and the air cooler cleaning injectors are operated by the control system simultaneously during a washing cycle.

2. The automated washing system of claim 1, wherein the heating element heats the water in the water tank to a minimum of 95° C. before initiation of the washing cycle.

3. The automated washing system of claim 1, wherein the set of air intake/port/valve cleaning injectors has at least one injector per engine cylinder.

4. The automated washing system of claim 1, wherein the air cooler cleaning injectors each comprises a plurality of orifices, the orifices arranged in five rows:

a center row of orifices oriented perpendicular to a top surface of the air cooler;

two inner rows, one on each side of the center row, with orifices oriented at a 15-degree angle from perpendicular to the top surface of the air cooler; and two outer rows, one on each outer side of each inner row, with orifices oriented at a 30-degree angle from perpendicular to the top surface of the air cooler.

5. The automated washing system of claim 4, wherein each row comprises 45 to 60 orifices.

6. The automated washing system of claim 4, wherein the orifices in each row are staggered from adjacent rows.

7. The automated washing system of claim 1, wherein the air cooler cleaning injectors each comprises a plurality of spray heads coupled to an injector pipe, each spray head comprising:

a center orifice oriented perpendicular to a top surface of the air cooler;

a first row of twelve orifices circumferentially oriented around the center orifice, oriented at 15 degrees from perpendicular to the top surface of the air cooler;

a second row of twelve orifices circumferentially oriented around the first row, oriented at 30 degrees from perpendicular to the top surface of the air cooler;

a third row of twelve orifices circumferentially oriented around the second row, oriented at 45 degrees from perpendicular to the top surface of the air cooler; and a fourth row of twelve orifices circumferentially oriented around the third row, oriented at 60 degrees from perpendicular to the top surface of the air cooler.

8. The automated washing system of claim 7, wherein each injector comprises three to five spray heads.

9. The automated washing system of claim 7, wherein spray heads are removable from the injector pipe and replaceable.

10. The automated washing system of claim 1, wherein the air intake port/valve cleaning injectors each comprises a spray head comprising:

a center orifice oriented perpendicular to the intake port/valve;

a first row of twelve orifices circumferentially oriented around the center orifice, oriented at 15 degrees from perpendicular to the intake port/valve; and a second row of twelve orifices circumferentially oriented around the first row, oriented at 30 degrees from perpendicular to the intake port/valve.

11. The automated washing system of claim 1, wherein the air compressor cleaning injectors each comprises a spray heard comprising:

a center orifice oriented perpendicular to the compressor impeller;

a first row of twelve orifices circumferentially oriented around the center orifice, oriented at 15 degrees from perpendicular to the compressor impeller; and a second row of twelve orifices circumferentially oriented around the first row, oriented at 30 degrees from perpendicular to the compressor impeller.

12. The automated washing system of claim 1, further comprising a set or turbine cleaning injectors operative to wash a turbine side of a turbocharger.

13. A method of automatically washing an internal combustion engine, comprising:

detecting that the engine is in a state which requires a washing;

activating, via a control system, a set of air compressor cleaning injectors and a set of air cooler cleaning injectors operably coupled to the control system, simultaneously to wash a compressor side of a turbocharger and air cooler, respectively, the air compressor cleaning injectors and the air cooler cleaner injectors each coupled to and drawing water from a water tank, the water tank having a heating element to heat water within the water tank;

deactivating the air compressor cleaning injectors and the air cooler cleaning injectors; and activating a set of air intake valve/port cleaning injectors coupled to the water tank to wash air intake valves/ports in an air intake manifold, wherein the method is executed while the engine is in operation.

14. The method of claim 13, further including activating a set of turbine cleaning injectors to wash a turbine side of the turbocharger.

15. The method of claim 14, wherein the activation of the turbine cleaning injectors is performed via manual input.

16. The method of claim 13, further including sourcing water for each activation step from the water tank.

17. The method of claim 16, further including heating the water in the water tank to at least 95° C. prior to each activation step.

18. The method of claim 17, further including refilling the water tank between each activation step.

* * * * *